US007481376B2

(12) United States Patent
Hornby et al.

(10) Patent No.: US 7,481,376 B2
(45) Date of Patent: Jan. 27, 2009

(54) VARIABLE INDUCTIVE HEATED INJECTOR

(75) Inventors: Michael J. Hornby, Williamsburg, VA (US); John Nally, Williamsburg, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 11/723,050

(22) Filed: Mar. 16, 2007

(65) Prior Publication Data

US 2007/0235557 A1 Oct. 11, 2007

Related U.S. Application Data

(60) Provisional application No. 60/783,219, filed on Mar. 17, 2006.

(51) Int. Cl.
*F02D 1/06* (2006.01)

(52) U.S. Cl. ..... 239/5; 239/133; 239/135; 239/128; 239/585.1; 239/585.4

(58) Field of Classification Search ..... 239/585.1, 239/133, 135, 128, 5, 585.4; 125/549; 137/341
See application file for complete search history.

(56) References Cited

U.S. PATENT DOCUMENTS 4,074,101 A * 2/1978 Kiuchi et al. ..... 219/601
4,572,146 A * 2/1986 Grunwald et al. ..... 123/549
4,648,361 A * 3/1987 Hales ..... 123/179.21
4,934,907 A * 6/1990 Kroner ..... 417/417
5,172,675 A * 12/1992 Kurosu et al. ..... 123/599
5,664,547 A * 9/1997 Klak et al. ..... 123/549
5,758,826 A * 6/1998 Nines ..... 239/136
5,915,626 A * 6/1999 Awarzamani et al. ..... 239/135
6,176,226 B1 1/2001 Nines et al.
6,334,418 B1 1/2002 Hubbard
6,621,226 B2 * 9/2003 Kim et al. ..... 315/105
6,685,112 B1 2/2004 Hornby

FOREIGN PATENT DOCUMENTS

JP 2002 180919 A 6/2002

* cited by examiner

*Primary Examiner*—Dinh Q Nguyen

(57) ABSTRACT

A fuel injector for an internal combustion engine includes a valve body 14. A valve seat 18 is associated with the valve body. The valve seat defines an outlet opening 24 through which fuel may flow. An armature 38 is associated with the valve body and is movable with respect to the valve body between a first position and a second position. The armature is associated with a closure member 24 proximate the outlet opening and contiguous to the valve seat when in the first position, and spaced from the valve seat when in the second position. An electromagnetic coil 44 is energizable to provide magnetic flux that moves the armature between the first and second positions to control liquid fuel flow through the outlet opening. A heating coil 50 is energizable to provide heat and thereby vaporize liquid fuel as it exits the outlet opening.

24 Claims, 5 Drawing Sheets

VARIABLE INDUCTIVE HEATED INJECTOR

This application claims the benefit of the earlier filing date of U.S. Provisional Application No. 60/783,219, filed on Mar. 17, 2006, which is incorporated by reference herein in its entirety.

FIELD OF THE INVENTION

This invention relates to automotive fuel injection and, more particularly, to inductive heating in a fuel injector.

BACKGROUND OF THE INVENTION

Federal and state governments have imposed increasingly strict regulations over the years governing the levels of hydrocarbon (HC), carbon monoxide (CO) and nitrogen oxide (NOx) pollutants that a motor vehicle may emit to the atmosphere.

One approach to reducing the emissions of these pollutants involves the use of a catalytic converter. The catalytic converter is placed within the exhaust gas stream between the exhaust manifold of the engine and the muffler of a vehicle.

A large percentage of a vehicles total cold start HC emissions occur during the time period while the catalytic converter is warming-up to operating temperature.

Several attempts have been made to reduce cold start emissions. For example: the catalytic converter has been moved as close to the engine as possible. In cases where the entire converter could not be moved close enough to the engine, a smaller warm-up converter is often used ahead of a second under-floor converter. In addition, catalytic converter improvements such as improved catalysts, and high-cell-density ceramic substrates with very thin walls that require less heat energy to reach operating temperature have been employed to reduce cold start emissions.

None of the above-mentioned approaches involves a fuel injector. Thus, there is a need to improve a fuel injector to more efficiently control the ignition and combustion properties during cold start-up to promote rapid catalyst warm-up.

SUMMARY OF THE INVENTION

An object of the invention is to fulfill the need referred to above. In accordance with the principles of the present invention, this objective is achieved by providing a fuel injector for an internal combustion engine. The fuel injector includes a valve body with a valve seat associated with the valve body. The valve seat defines an outlet opening through which fuel may flow. An armature is associated with the valve body and is movable with respect to the valve body between a first position and a second position. The armature is associated with a closure member proximate the outlet opening and contiguous to the valve seat when in the first position, and spaced from the valve seat when in the second position. An electromagnetic coil is energizable to provide magnetic flux that moves the armature between the first and second positions to control liquid fuel flow through the outlet opening. A heating coil is energizable to provide heat and thereby vaporize liquid fuel as it exits the outlet opening.

In accordance with another aspect of the invention, a method of vaporizing fuel as it exits a fuel injector of an internal combustion engine provides a fuel injector having heating structure constructed and arranged to heat liquid fuel. The liquid fuel is heated with the heating structure to vaporize the liquid fuel as it exits the fuel injector.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which:

FIG. 3 is a voltage waveform when the heating coil of the fuel injector of FIG. 1 is on.

DETAILED DESCRIPTION OF THE EXEMPLARY EMBODIMENT

Figure 1:
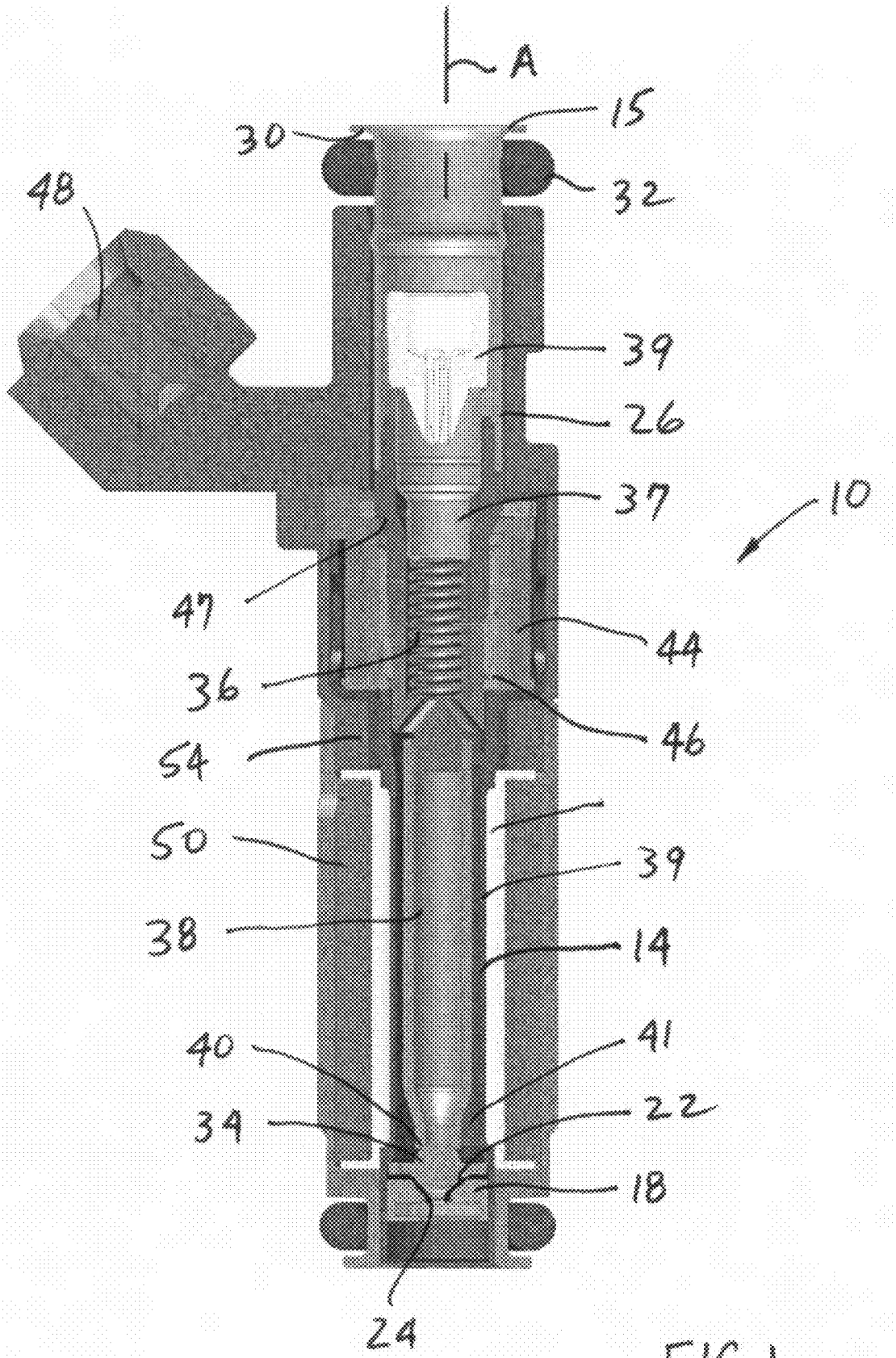
FIG. 1 is a sectional view of a fuel injector having a heating coil in accordance with an embodiment of the present invention.

Referring to FIG. 1, a solenoid actuated fuel injector, generally indicated at 10, which can be of the so-called top feed type, supplies fuel to an internal combustion engine (not shown). The fuel injector 10 includes a valve body 14 extending along a longitudinal axis A. The valve body 14 includes a valve seat 18 defining a seating surface 22, which can have a frustoconical or concave shape, facing the interior of the valve body 14. The seating surface 22 includes a fuel outlet opening 24 centered on the axis A and in communication with an inlet tube 26 for conducting pressurized fuel into the valve body 14 against the seating surface 22. The inlet tube 26 defines an inlet end 15 of the injector 10 and has a retainer 30 for mounting the fuel injector 10 in a fuel rail (not shown) as is known. An O-ring 32 is used to seal the inlet end 15 in the fuel rail.

A closure member, e.g., a spherical valve ball 34, within the injector 10 is moveable between a first, seated, i.e., closed, position and a second, open position. In the closed position, the ball 34 is urged against the seating surface 22 to close the outlet opening 24 against fuel flow. In the open position, the ball 34 is spaced from the seating surface 22 to allow fuel flow through the outlet opening 24.

An armature 38 that is axially moveable along axis A in a tube portion 39 of the valve body 14 includes valve ball capturing means 40 at an end proximate the seating surface 22. The valve ball capturing means 40 engages with the valve ball 34 outer surface adjacent the seating surface 22 and so that the valve ball 34 rests on the seating surface 22 in the closed position of the valve ball 34. A spring 36 biases the armature 38 and thus the valve ball 34 toward the closed position. The fuel injector 10 may be calibrated by positioning adjustment tube 37 axially within inlet tube 26 to preload spring 36 to a desired bias force. A filter 39 is provided within the tube 37 to filter fuel. The valve body 14, armature 38, valve seat 18 and valve ball 34 define a valve group assembly such as disclosed in U.S. Pat. No. 6,685,112 B1, the contents of which is hereby incorporated herein by reference.

The electromagnetic coil 44 surrounds a pole piece or stator 47 formed of a ferromagnetic material. The electromagnetic coil 44 is operable, in the conventional manner, to produce magnetic flux to draw the armature 38 away from the seating surface 22, thereby moving the valve ball 34 to the open position and allowing fuel to pass through the fuel outlet opening 24. Deactivation of the electromagnetic coil 44 allows the spring 36 to return the valve ball 34 to the closed position against the seating surface 22 and to align itself in the closed position, thereby closing the outlet opening 24 against the passage of fuel. The electromagnetic coil is DC operated.

The coil 44 with bobbin, and stator 47 are preferably overmolded to define a power or coil subassembly such has disclosed in U.S. Pat. No. 6,685,112 B1.

A non-magnetic sleeve 46 is pressed onto one end of the inlet tube 26 and the sleeve 46 and inlet tube 26 are welded together to provide a first hermetic joint therebetween. The sleeve 46 and inlet tube 26 are then pressed into the valve body 14, and the sleeve 46 and valve body 14 are welded together to provide a second hermetic joint therebetween.

The fuel passage 41 is defined inside the valve body 14 such that fuel introduced into the inlet end 15 passes over the valve ball 34 and through the outlet opening 24 when the valve ball 24 is in the open position.

As shown in FIG. 1, a heating coil 50 is disposed about the tube portion 39 of the valve body 14 and is energizable to provide heat and to thereby vaporize liquid fuel. Thus, the heating coil 50 atomizes fuel using inductive heating in the injector 10 where the liquid fuel is vaporized as it exits the outlet opening 24 for use during the cold start phase. Vaporized fuel will readily mix with the inlet air to enable a much reduced HC emission cold start. This is accomplished through the ability to more efficiently control the ignition and combustion properties during the cold start to promote rapid catalyst warm-up while maintaining operator drivability. A benefit is the ability to enable an open inlet valve injection strategy with reduced transient fueling issues.

Figure 2:
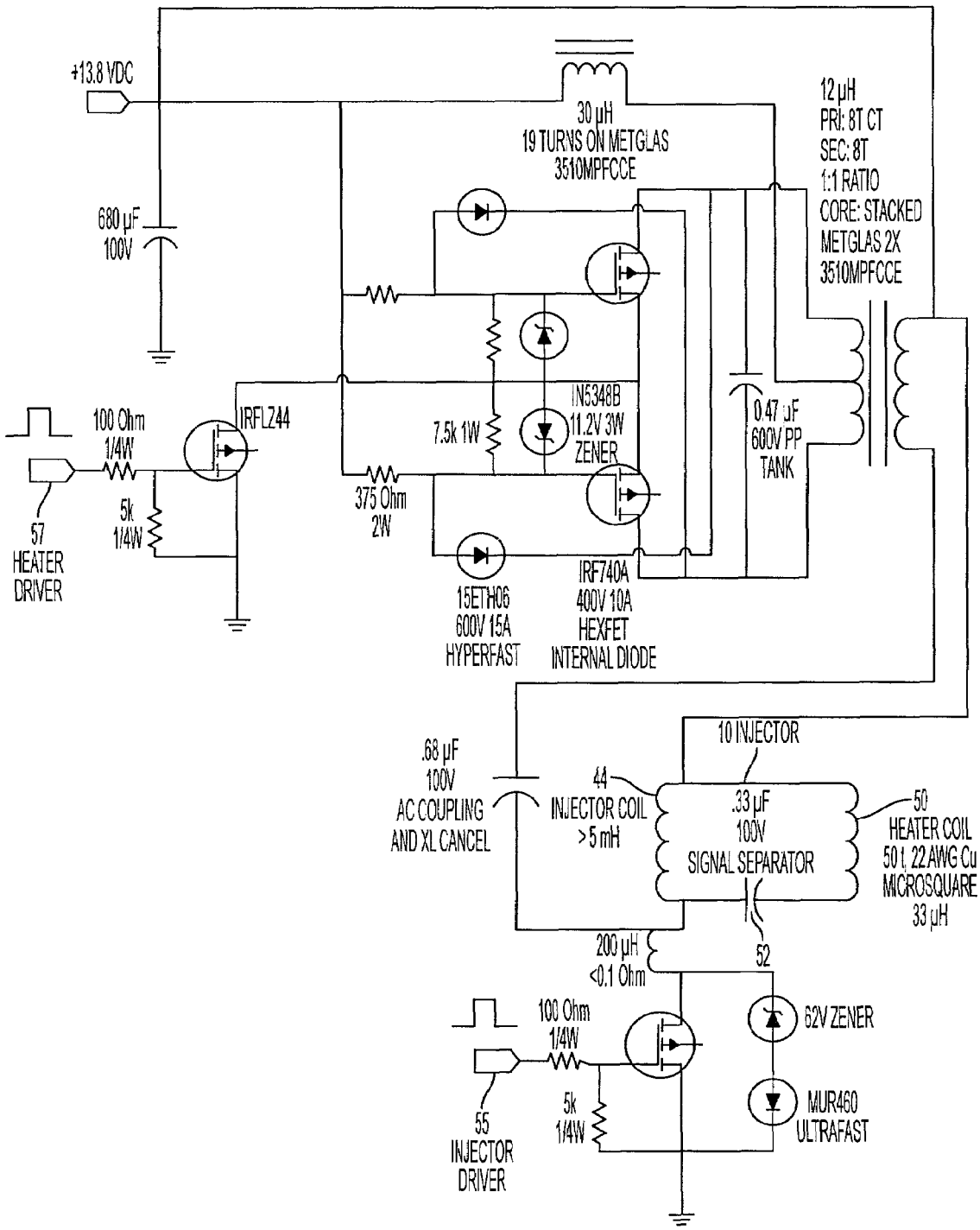
FIG. 2 is a schematic view of a circuit for driving the injector of FIG. 1.

A circuit for driving the injector 10 and the heating coil 50 is shown in FIG. 2. As shown, a capacitor 52 is electrically connected between the electromagnetic coil 44 and the heating coil 50 so as to separate the coil 44 from coil 50. Returning to FIG. 1, a space 54 is provided between the electromagnetic coil 44 and the heating coil 50 to accommodate the capacitor 52 (not shown in FIG. 1). The heating coil 50 operates on alternating current (AC). With reference to FIG. 2, only two wires are required to connect the injector 10 to the Engine Control Unit (including the injector driver 55) and to the heater driver 57. Thus, a two wire electrical connector 48 is used to power the injector 10. The frequency of the heater driver is preferably 40 kHz.

Figure 3:
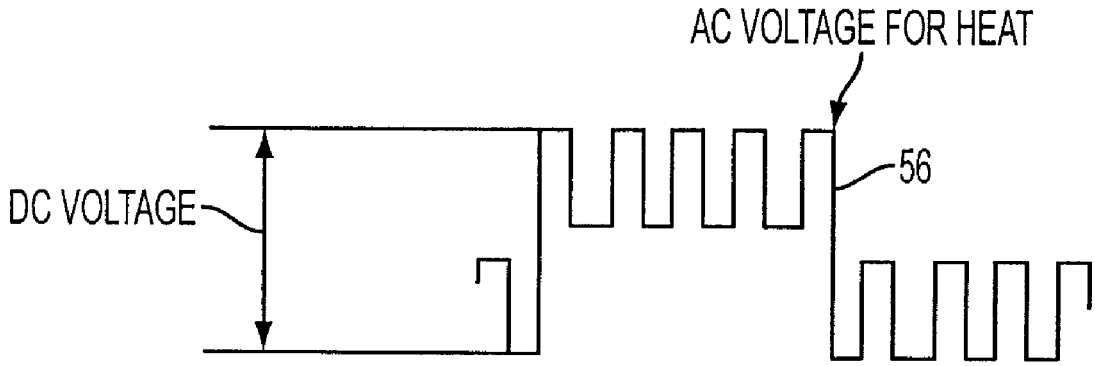
Figure 4:
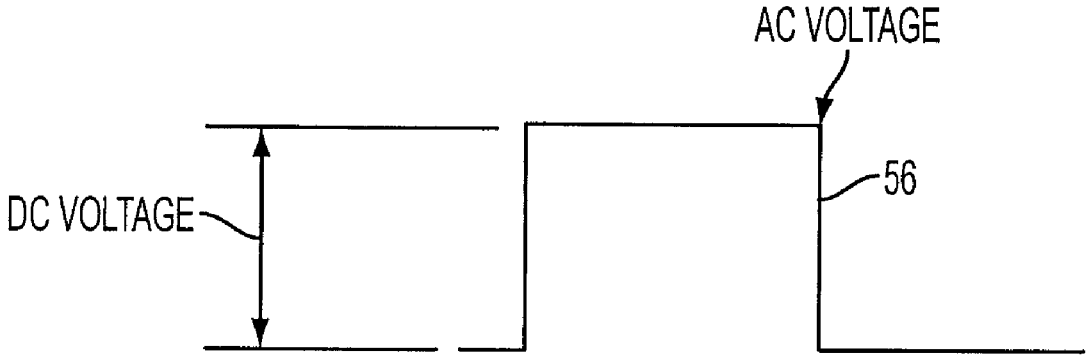
FIG. 4 is a voltage waveform when the heating coil of the fuel injector of FIG. 1 is off.

A voltage waveform 56 is shown in FIG. 3, when the heating coil 50 of the fuel injector 10 is on, and the voltage waveform 56 is shown in FIG. 4 when the heating coil 50 is off. The electromagnetic coil 44 uses the conventional pulse width DC modulation to open and close the injector 10. The heating coil 50, on the same circuit, uses AC current to inductively heat an portion of the armature 38. Preferably, the heating coil 50 is a two layer winding with 22 gage square wire and 50 turns. The AC to the heating coil 50 can be turned on or off based on when vapor is needed.

As shown in FIG. 1, the heating coil 50 and the electromagnetic coil 44 are preferably provided as a unit for ease in assembly. The heating coil surrounds the valve body 14. Preferably, there is an air gap between the heating coil 50 and the valve body 14 to keep a bobbin of the heating coil from melting. A wall of the valve body is made thin enough so as to be heated by the coil 50. The fuel passage 41 is provided between an inside of the tube portion 39 of the valve body 14 and the outer periphery of the armature 38 so as to quickly heat the fuel. The armature 38 is of hollow tube shape and is constructed and arranged to direct the fuel around the outside of the tube. Since the armature 38 is a hollow tube, it is light-weight and has a reduced heat mass so it can also heat quickly.

Figure 5:
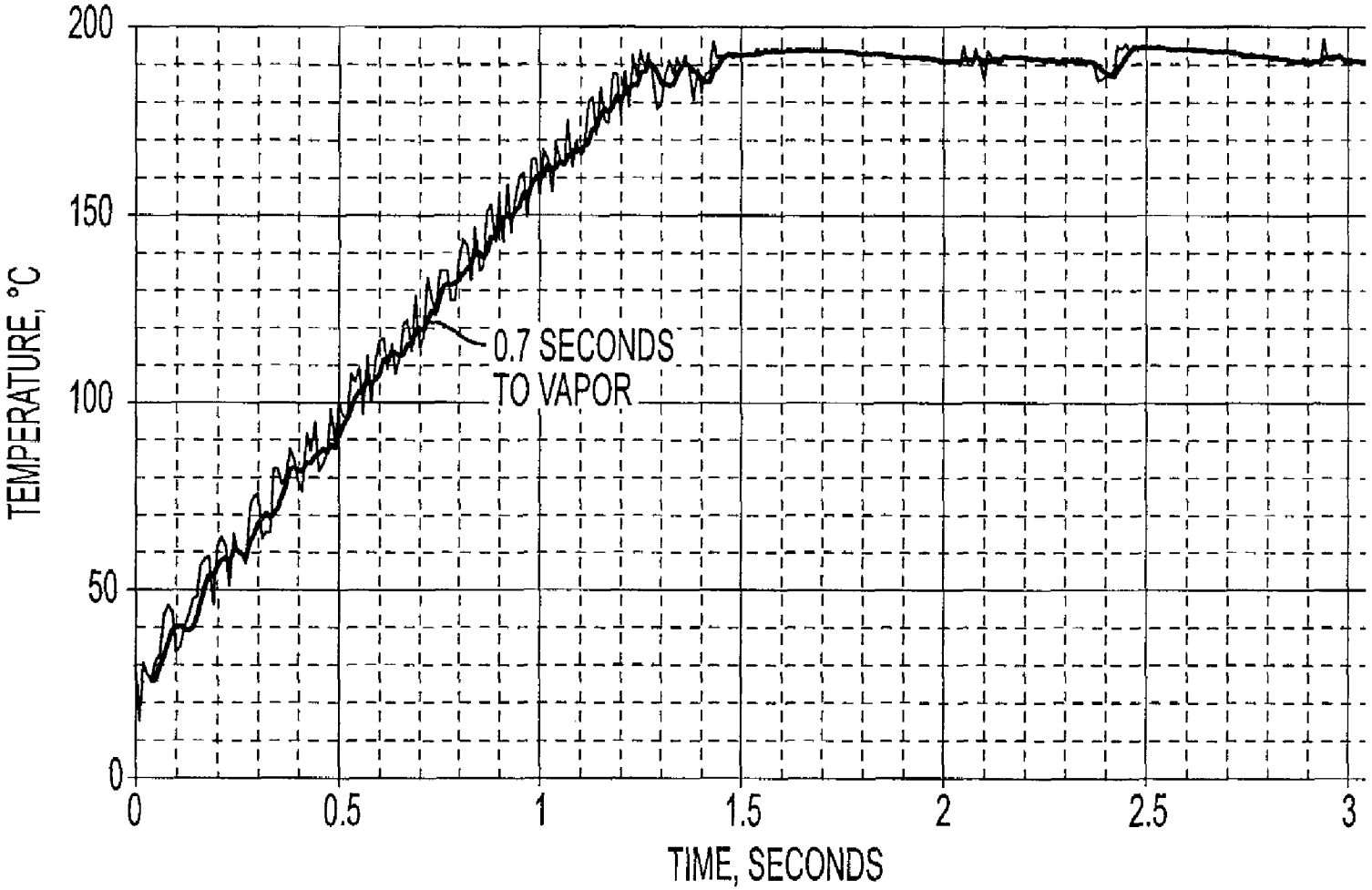
FIG. 5 is a graph of showing the temperature of fuel at certain times when the heating coil of the injector of FIG. 1 is activated.

FIG. 5 is a graph of a test of the heater driver 57 showing that vapor occurs rapidly (e.g., in 0.7 seconds) when the heating coil 50 is turned on.

The particle size measured 32 microns Sauter Mean Diameter (SMD) during heating of the fuel using the heating coil 50. This measurement was taken at 50 mm from the tip of the injector instead of the traditional 100 mm. The injector 10 can be used in alcohol and gasoline, and flex fuel applications.

Some features of the injector 10 are as follows. The injector 10 with heating coil 50 enables lower cold start HC emissions. Lean operation with stable combustion is achieved during the cold warm-up phase. The injector 10 may be operated with retarded spark timing as a heat source for faster catalyst light-off. The injector 10 offers a system with minor modifications to customers engines. With the injector 10, an increase of system LR can be achieved due to operation on vapor at low demand conditions.

Figure 6:
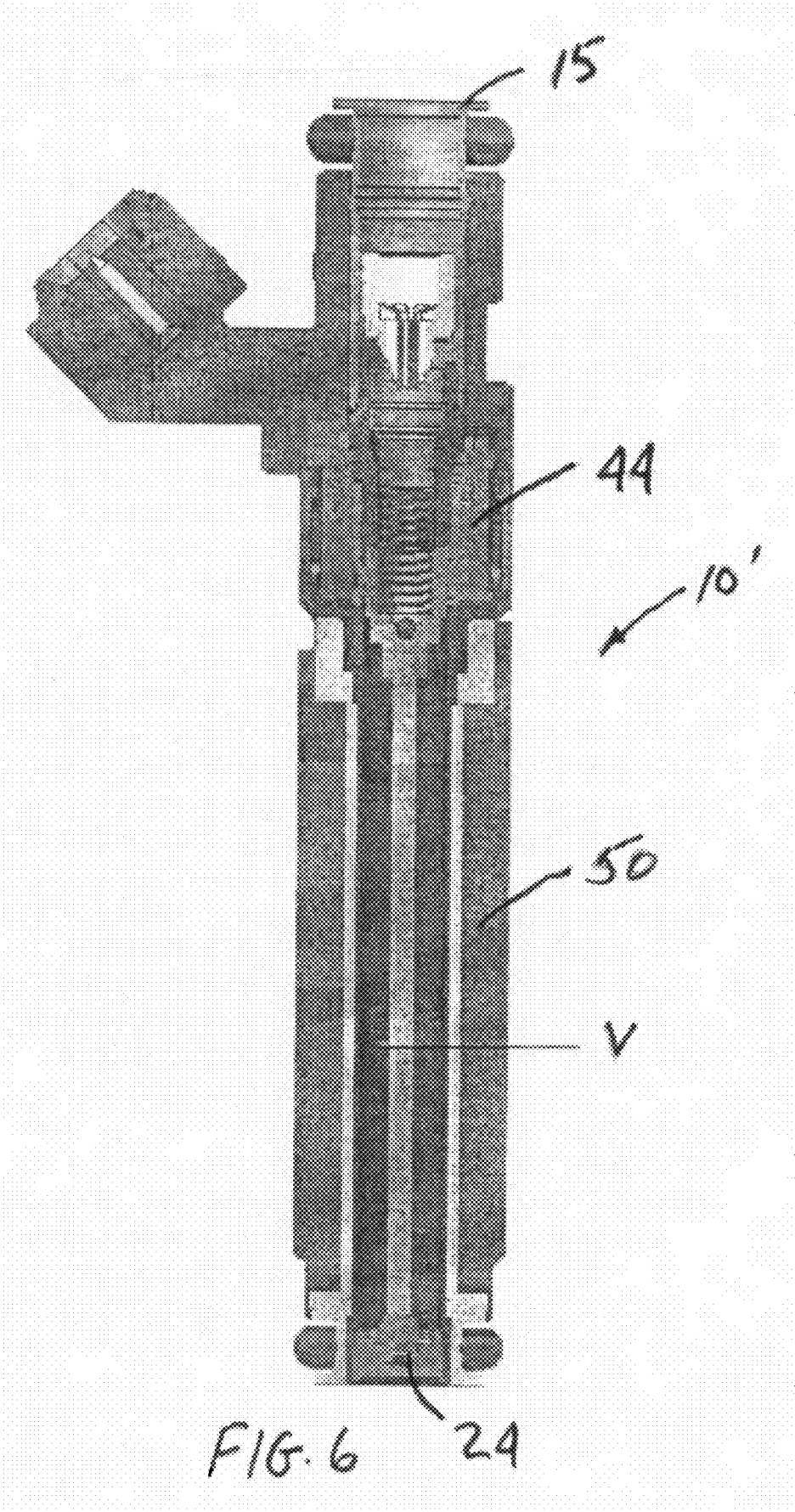
FIG. 6 is another embodiment of an injector having an increase fuel heating volume.

With reference to FIG. 6, another embodiment of an injector 10' is shown. The injector 10' is substantially similar to the injector 10 of FIG. 1, except that injector 10' has an increased fuel heating volume V. Thus, the heating volume is increased from 0.1 cc (FIG. 1) to 0.9 cc (FIG. 6).

The injector 10' can be used for Flex Fuel Start applications to reduce emissions when E100 and E85 are the fuels used. The injector 10' enables efficient vehicle starts with E100 down to temperatures of −5 C with 200 W heating power even if flash boiling is interrupted. In conventional E100 applications, a vehicle will not start at 20 C and these applications require an additional gasoline tank as a start system.

With the injector 10, 10' in E85 applications, the oil dilution is reduced by 2.5 times and the start emissions are significantly reduced and are equal to that of a gasoline application. The injector 10' enables efficient vehicle starts with E85 down to temperatures of −30 C.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector for an internal combustion engine, comprising:

a valve body;

a valve seat associated with the valve body, the valve seat defining an outlet opening through which fuel may flow;

an armature associated with the valve body and movable with respect to the valve body between a first position and a second position, the armature being associated with a closure member proximate the outlet opening and contiguous to the valve seat when in the first position, and spaced from the valve seat when in the second position;

an electromagnetic coil being energizable to provide magnetic flux that moves the armature between the first and second positions to control liquid fuel flow through the outlet opening;

a secondary coil being energizable to provide a magnetic field to inductively heat the valve body and thereby vaporize liquid fuel as it exits the outlet opening, and a capacitor electrically connected between the electromagnetic coil and the heating coil, wherein the electromagnetic coil is on a circuit and is constructed and arranged to receive pulse width direct current modulation from the circuit, and wherein the secondary coil is on the same said circuit and is constructed and arranged to receive alternating current from said circuit.

2. The fuel injector according to claim 1, wherein the valve body includes a tube portion and the armature is disposed in the tube portion, a fuel passage is defined between an outer periphery of the armature and an inside of the tube portion, the secondary coil being disposed about the tube portion so as to heat the tube portion and thus fuel in the fuel passage.

3. The fuel injector according to claim 2, wherein an air gap is provided between the secondary coil and the tube portion of the valve body.

4. The fuel injector according to claim 2, wherein an air gap is provided between the secondary coil and the tube portion.

5. The fuel injector according to claim 1, wherein only two wires are provided to power the injector.

6. The fuel injector according to claim 5, in combination with a heater driver for driving the secondary coil and an injector driver for driving the electromagnetic coil.

7. The combination according to claim 6, wherein the heater driver operates at a frequency of 40 kHz.

8. The fuel injector according to claim 1, wherein the electromagnetic coil and the secondary coil define a unit.

9. The fuel injector according to claim 1, wherein the secondary coil is a two-layer winding with 22 gage square wire and 50 turns.

10. The fuel injector according to claim 1, wherein the armature is a sealed hollow tube with a periphery thereof being constructed and arranged to direct fuel there-around.

11. The fuel injector according to claim 1, wherein E85 is the fuel.

12. The fuel injector according to clam 1, wherein E100 is the fuel.

13. A fuel injector for an internal combustion engine, comprising:

a valve body;

a valve seat associated with the valve body, the valve seat defining an outlet opening through which fuel may flow;

an armature associated with the valve body and movable with respect to the valve body between a first position and a second position, the armature being associated with a closure member proximate the outlet opening and contiguous to the valve seat when in the first position, and spaced from the valve seat when in the second position;

an electromagnetic coil on a circuit and being energizable to provide magnetic flux that moves the armature between the first and second positions to control liquid fuel flow through the outlet opening; and means for inductively heating the valve body thus vaporizing liquid fuel as it exits the outlet opening, wherein the electromagnetic coil is constructed and arranged to receive pulse width direct current modulation from the circuit and wherein the means for vaporizing is a heating coil on the same said circuit and constructed and arranged to receive alternating current from said circuit.

14. The fuel injector according to claim 13, wherein the valve body includes a tube portion and the armature is disposed in the tube portion, a fuel passage is defined between an outer periphery of the armature and an inside of the tube portion, the means for inductively heating being a secondary coil disposed about the tube portion so as to inductively heat the valve body and thus fuel in the fuel passage.

15. The fuel injector according to claim 14, wherein an air gap is provided between the secondary coil and the tube portion of the valve body.

16. The fuel injector according to claim 14, wherein an air gap is provided between the secondary coil and the tube portion.

17. The fuel injector according to claim 13, wherein the injector further comprises a capacitor electrically connected between the electromagnetic coil and the means for inductively heating.

18. The fuel injector according to claim 17, in combination with a heater driver for driving the means for inductively heating and an injector driver for driving the electromagnetic coil.

19. The combination according to claim 18, wherein the heater driver operates at a frequency of 40 kHz.

20. The fuel injector according to claim 13, wherein the means for inductively heating is a secondary coil having a two-layer winding with 22 gage square wire and 50 turns.

21. The fuel injector according to claim 13, wherein the armature is a sealed hollow tube with a periphery thereof being constructed and arranged to direct fuel there-around.

22. A method of vaporizing fuel as it exits a fuel injector of an internal combustion engine, the method including:

providing fuel injector having an electromagnetic coil on a circuit and energizable by direct current from the circuit to provide magnetic flux that moves an armature between the first and second positions to control liquid fuel flow through an outlet opening of the fuel injector and a secondary coil constructed and arranged to inductively heat a body of the fuel injector to heat liquid fuel;

energizing the secondary coil, on the same said circuit, with alternating current from said circuit to inductively heat the body, and permitting the heated body to vaporize the liquid fuel as it exits the fuel injector.

23. The method of claim 22, wherein the step of energizing includes creating a magnetic field by the secondary coil.

24. The method of claim 23, wherein an air gap is provided between the secondary coil and the body.

* * * * *